US010745899B2

(12) United States Patent
Guthrie

(10) Patent No.: US 10,745,899 B2
(45) Date of Patent: Aug. 18, 2020

(54) MODULAR WAXLESS SEAL AND ASSEMBLY

(71) Applicant: Kevin J. Guthrie, Wind Lake, WI (US)

(72) Inventor: Kevin J. Guthrie, Wind Lake, WI (US)

(73) Assignee: LAVELLE INDUSTRIES, INC., Burlington, WI (US)

( * ) Notice: Subject to any disclaimer, the term of this patent is extended or adjusted under 35 U.S.C. 154(b) by 124 days.

(21) Appl. No.: 16/136,439

(22) Filed: Sep. 20, 2018

(65) Prior Publication Data

US 2019/0085548 A1 Mar. 21, 2019

Related U.S. Application Data

(60) Provisional application No. 62/561,092, filed on Sep. 20, 2017.

(51) Int. Cl.
*E03D 11/17* (2006.01)
*E03D 11/16* (2006.01)

(52) U.S. Cl.
CPC ..... *E03D 11/17* (2013.01); *E03D 11/16* (2013.01)

(58) Field of Classification Search
CPC ..... E03D 11/16; E03D 11/17; F16L 23/16; F16L 23/22; F16L 23/24
See application file for complete search history.

(56) References Cited

U.S. PATENT DOCUMENTS

| | | | | |
|---|---|---|---|---|
| 2,976,543 | A | 1/1958 | Turner | |
| 3,349,412 | A | 10/1967 | Schwartz | |
| 4,482,161 | A * | 11/1984 | Izzi, Sr. | E03D 11/16 277/606 |
| 6,332,632 | B1 | 12/2001 | Hodges | |
| 7,814,580 | B2 | 10/2010 | Coronado et al. | |
| 8,069,502 | B2 | 12/2011 | Coronado et al. | |
| 9,273,455 | B2 * | 3/2016 | Schuster | F16L 5/10 |
| 9,556,603 | B2 * | 1/2017 | Guthrie | E03D 11/16 |
| 10,294,647 | B2 * | 5/2019 | Coronado | E03D 11/16 |
| 2004/0098798 | A1 | 5/2004 | Atkins | |
| 2014/0062035 | A1 * | 3/2014 | Coronado | E03D 11/16 277/607 |

* cited by examiner

*Primary Examiner* — David P Angwin
*Assistant Examiner* — Nicholas A Ros
(74) *Attorney, Agent, or Firm* — Joseph S. Heino; Erin E. Kaprelian

(57) ABSTRACT

A modular waxless seal for sealing a connection between a bottom of a toilet and a floor flange, the floor flange comprising a central aperture and opposing fasteners that extend upwardly from the floor flange, the seal comprises a rubber seal portion and at least one foam ring disposed above the top surface of the sealing ring of the rubber seal portion. The rubber seal portion and the foam rings comprise opposing ears that extend outwardly and each opposing ear comprises an aperture that aligns with one of the opposing fasteners of the floor flange.

8 Claims, 4 Drawing Sheets

MODULAR WAXLESS SEAL AND ASSEMBLY

This application claims priority to Provisional Patent Application No. 62/561,092, filed on Sep. 20, 2017.

FIELD OF THE INVENTION

The invention relates generally to toilets and toilet sealing products. More specifically, the invention relates to an improved modular waxless seal for preventing leaks at the junction and connection of the base of a toilet and a floor flange.

BACKGROUND OF THE INVENTION

Wax seals that are interposed between a toilet and a floor flange are well known in the art. For the most part, wax seals work relatively well and can last for a long time. However, when such wax seals fail and leak, the resulting waste water can damage floors and, if allowed to continue, can eventually cause damage to other parts of a home or building. Additionally, wax seals can generally only be "set" once and are generally difficult for non-professionals to install properly in that the wax used is extremely tacky and adheres to everything, including the hands of the installer. Further, and if the toilet is not tightened down properly over the wax seal, the seal can be damaged by unintended rocking of the toilet.

Therefore, in the experience of the inventor, there has been a long-felt need for a seal that is more modular in construct, is chemically resistant and does not absorb water. There is a further need for a seal with antimicrobial properties. Additionally, there is a need for a more resilient type of seal so as to provide an upward sealing force against the toilet. There is an additional need for a seal that directs waste water into and through the floor flange. One such waxless seal is disclosed and claimed in U.S. Pat. No. 9,556,603 titled MODULAR WAXLESS SEAL (the '603 patent). Though effective and reliable in use, the product disclosed and claimed in the '603 patent can be, and has been, improved by the embodiments disclosed in this application. For example, the waxless modular seal of the '603 patent includes one or more foam rings comprised of closed cell polyvinyl chloride (PVC) foam whereas the present invention uses a proprietary open cell foam for similar rings. Further, the waxless modular seal of the '603 patent utilizes a pair of sealing rings between which the foam rings are captured. The present invention uses a singular rubber seal structure.

SUMMARY OF THE INVENTION

In accordance with the foregoing, the present invention provides a modular waxless seal that is intended to replace traditional wax seals. Two preferred embodiments are presented and each comprises two essential components. The first component is a compressive foam ring, which can comprise a plurality of such rings if required for a particular application. The second is a rubber seal. When installed as intended, the foam ring, or rings, is/are compressively disposed directly below a toilet bowl bottom and the rubber seal is disposed under the foam ring(s) and on top of the upper surface of the floor flange.

As configured according to the present invention, the rubber seal effectively "bridges" and seals all openings on the floor flange. The rubber seal is fabricated using a chemically resistant material that is sold under the brand name CHLORAZONE® (CHLORAZONE is a registered mark of Lavelle Industries, Inc.). The rubber seal is the only component that is intended to be contacted by waste water traveling from the toilet and through the floor flange during normal intended use. Only when the drain pipe below the floor flange backs up is there the potential for waste water coming into contact with the compressive foam ring(s) via a path between the top of the floor flange and the bottom of the rubber seal.

Two compressive foam rings are provided, but not necessarily used. The compressive foam rings are manufactured from an open cell foam that is both chemically resistant and has very low absorption of water. The open cell foam material has been engineered to allow a specific compression force and to provide a rebound memory force so as to maintain the seal. One is a thin compressive foam ring and the other is a thick compressive foam ring. Both the thick and thin foam rings are fabricated from a proprietary open cell material that has a special formulation and is fabricated using a process that creates a sealing skin on all sides of the foam rings.

Importantly, both top and bottom surfaces of the ring and seal combination that are in contact with the floor flange and the toilet underside create a pressure tight seal. Additionally, the modular waxless seal is clean in that it uses no adhesives that could otherwise stick to an installer's hands or other surface during installation. Likewise, the modular waxless seal is much easier to remove and replace than is a customary wax seal. Further, the modular waxless seal can provide certain anti-microbial properties. The modular waxless seal of the present invention can also be used in above floor installations, below floor installations and flush installations by using a different height open cell foam foam in combination with the seal.

The foregoing and other features of the modular waxless seal will be apparent from the detailed description that follows.

DETAILED DESCRIPTION OF THE INVENTION

Figure 1:
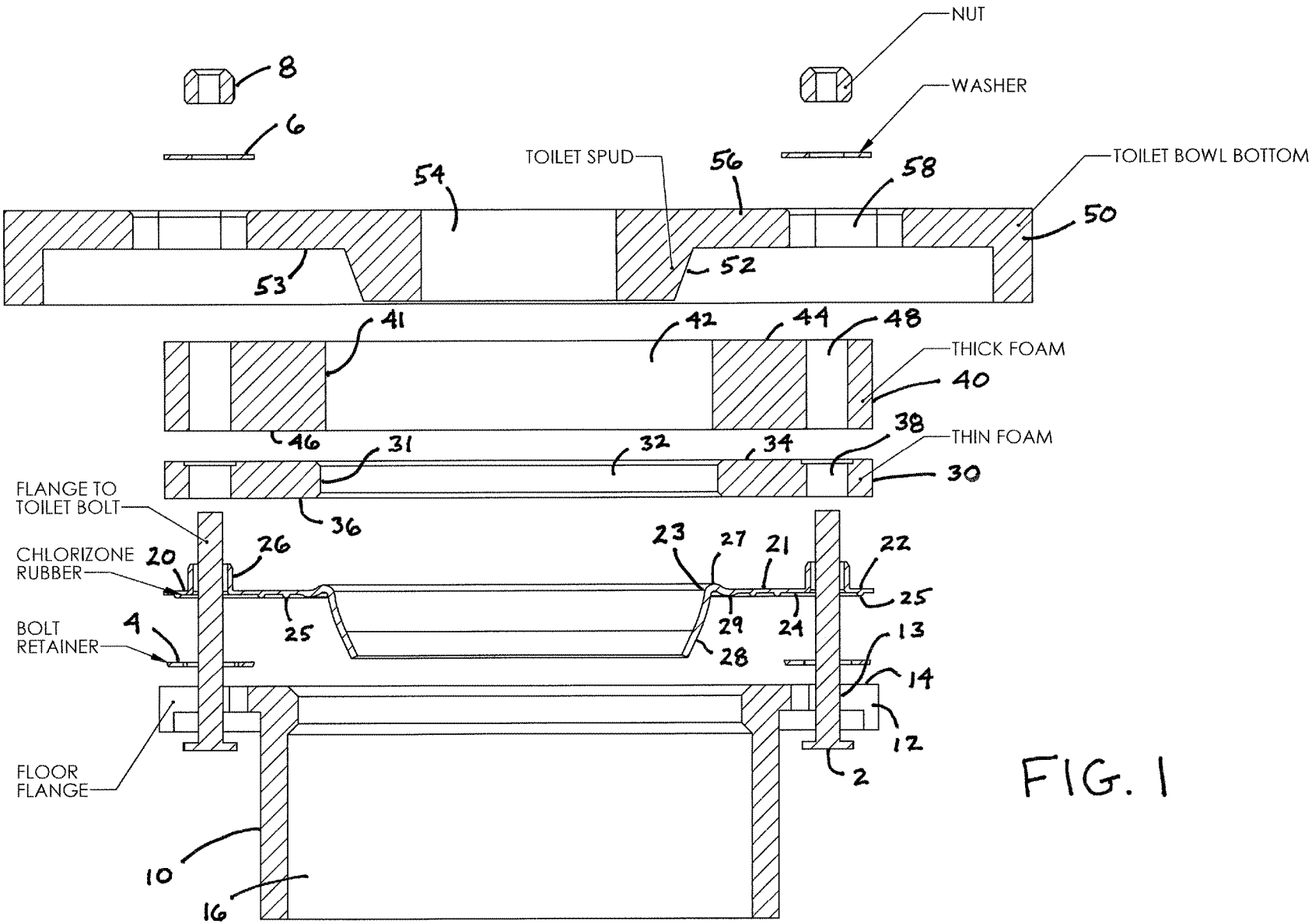
FIG. 1 is a side cross-sectional and exploded pre-installation view of a first preferred embodiment of the modular waxless seal described herein.

Referring now to the drawings in detail, wherein like-numbered elements refer to like elements throughout, FIG. 1 illustrates first preferred embodiment of the modular waxless seal of the invention. The view is in cross-section and it is to be understood that the primary elements are circular in shape.

As shown, a toilet bowl bottom 50 is positioned to be installed over a floor flange 10. The floor flange 10 is generally a round structure providing a central aperture 16, which is a waste hole, and a circumferential flange 12 that further comprises a pair of opposing apertures 13. That is, the apertures 13 are disposed 180° from one another. Mounting bolts 2 are provided and are pre-placed substantially vertically so as to protrude upwardly through the apertures 13 that are defined within the flange 12. The mounting bolts 2 are retained in vertical position relative to the floor flange 10 and prevented from dropping out of the floor flange 10 via bolt retainers 4. The floor flange 10 also comprises a top surface 14.

As shown in FIG. 1, the toilet bowl bottom 50 comprises a toilet spud 52, a waste hole 54 and a flange 56. The flange 56 further comprises a pair of apertures 58 that are intended to align with the mounting bolts 2 that protrude upwardly form the floor flange 10. The toilet bowl bottom 50 is secured to the floor flange 10 by placing a washer 6 and threading a nut 8 onto the mounting bolt 2 to secure the toilet bowl bottom 50 to the floor flange 10. However, a seal of some sort needs to be interposed between the toilet bowl bottom 50 and the floor flange 10 to properly seal those two structures against waste water leaks between them, which is the purpose of providing the aforementioned wax seal. The present invention provides a more desirable alternative.

Figure 1A:
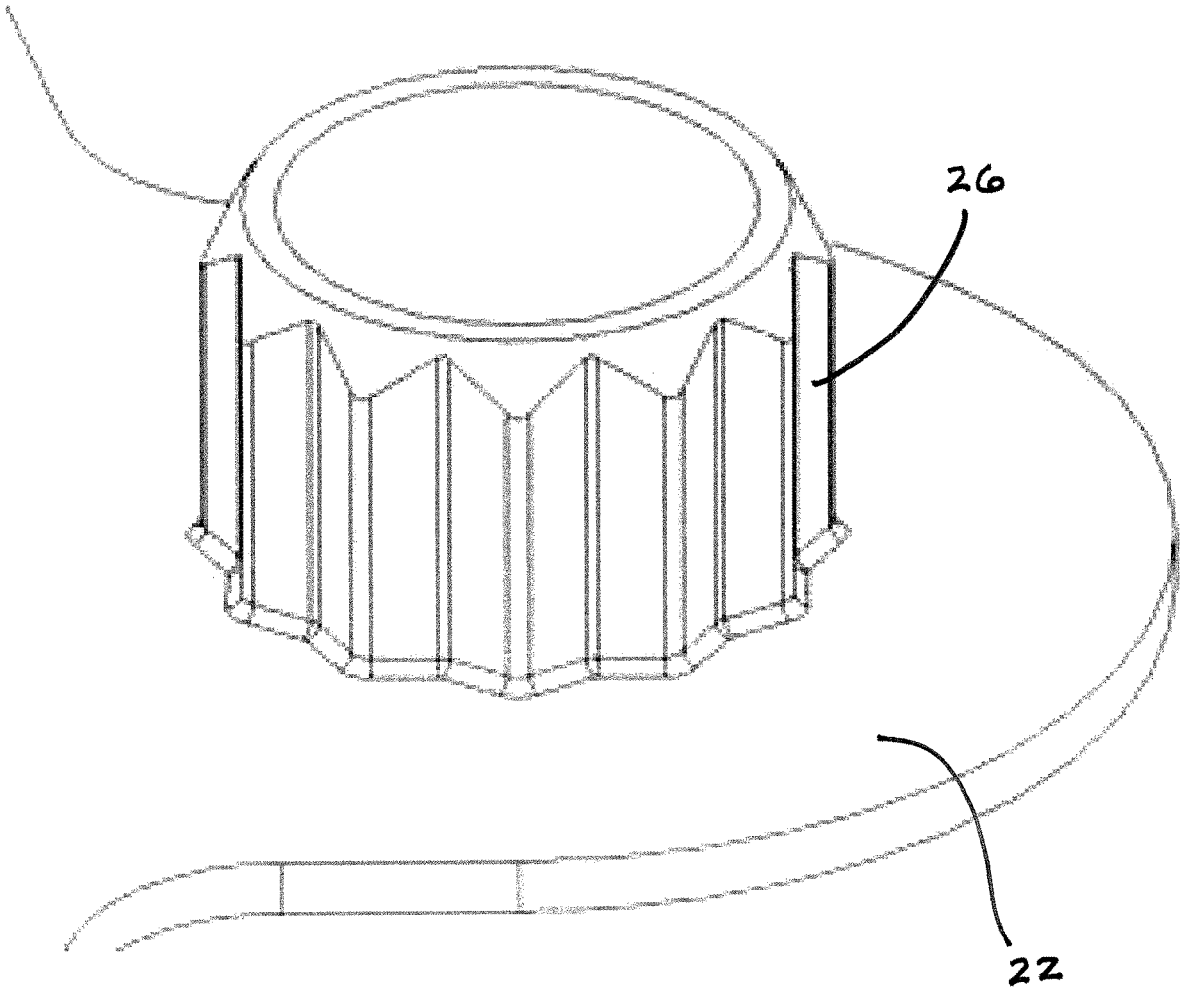
FIG. 1A is an enlarged perspective view of a portion of the sealing ring and sealing ring sleeve illustrated in FIG. 1.

Specifically, the present invention provides a modular waxless seal 20 for sealing a connection between the bottom 53 of the toilet 50, and the toilet spud 52 in particular, and the top surface 14 of the floor flange 10, and further includes at least one foam ring 30, 40. The waxless seal 20, together with one of the foam rings 30, 40, is interposed between the toilet bowl bottom 50 and the floor flange 10. It is possible that both foam rings 30, 40 could be used in a given application when necessary. The foam rings 30, 40 are toroid-shaped structures and have a rectangular cross section. The modular waxless seal 20 comprises a chemical resistant Chlorazone® rubber seal portion and several essential elements that are integrally formed as a single structure with the seal portion. Those elements are a substantially flat and horizontally disposed sealing ring 22, a sealing ring sleeve 26 that extends upwardly from the sealing ring 22 and a ring cone 28 that extends downwardly from the innermost portion of the sealing ring 22. The sealing ring sleeve 26 provides a radial interference fit. That is, the shape of the sealing ring sleeve 26 allows the rubber and foam to be properly aligned by a radial mechanical interference. See FIG. 1A. One foam ring 30 is considered a "thin" foam structure relative to the other foam ring 40, which is considered a "thick" foam structure. The radial interference fit of the sealing ring sleeve 26 works with both foam rings 30, 40.

More specifically, the rubber seal portion 20 comprises a planar and outwardly extending integral sealing ring 22. The sealing ring 22 has a top surface 21. When the sealing ring 22 is aligned with the fasteners 2, the integral sealing ring sleeve 26 extends upwardly from the top surface 21 of the sealing ring 22 to provide a further waste water sealing point. Inwardly of the sealing ring 22, the rubber seal 20 further comprises the integral ring cone 28 that is tapered inwardly and downwardly from the innermost radial circumference of the sealing ring 22. An arcuate elevation 27 is presented at the uppermost perimeter 23 of the ring cone 28. In all other respects, the seal ring top surface 21 is substantially flat so as to provide a support surface for one or the other of the foam rings 30, 40.

The sealing ring 22 further comprises a bottom surface 24 having a plurality of annular flange beads 25 extending downwardly from that surface 24. A larger flange bead 29 is disposed at the top of the ring cone 28 immediately adjacent to and inwardly from the elevation 27. This larger bead 29 forms the primary barrier to the flow of any waste water between the seal 20 and the floor flange 10 and extends downwardly from the bottom surface 24 of the sealing ring 22. As mentioned earlier, the rubber seal 20 and its sealing ring 22 as configured in this fashion effectively "bridges" and seals all openings on the floor flange 10 when compressed.

Although not shown, the rubber seal 20 and the foam rings 30, 40 comprise opposing "ears" that extend outwardly from the body of those elements and align with the fasteners 2. Similar to the fasteners 2, the ears are disposed 180° from one another in these structures as well, which complements the position of the fasteners 2 of the floor flange 10. This shape is the same as that described and illustrated in the '603 patent.

Each of the foam rings 30, 40 comprises a primary and centrally disposed aperture 32, 42 which comprises an inward facing vertical surface 31, 41, respectively. These surfaces 31, 41 form an impenetrable barrier to any waste water flowing from the toilet waste hole 54 of the toilet bottom 50 and the ring cone 28 of the modular waxless seal 20. Each foam ring 30, 40 also comprises a top surface 34, 44 and a bottom surface 36, 46, respectively. Each foam ring 30, 40 also comprises two secondary apertures 38, 48, respectively, that are defined in the ear structures thereof. Further, each foam ring 30, 40 is constructed of a special formulation that creates a sealing skin on all of the outer surfaces of the foam rings 30, 40. Both foam rings 30, 40, once compressed under the weight of the toilet bowl bottom 50, prevents water absorption that is measurable. A pressure tight seal is created by this unique and novel configuration.

Figure 2:
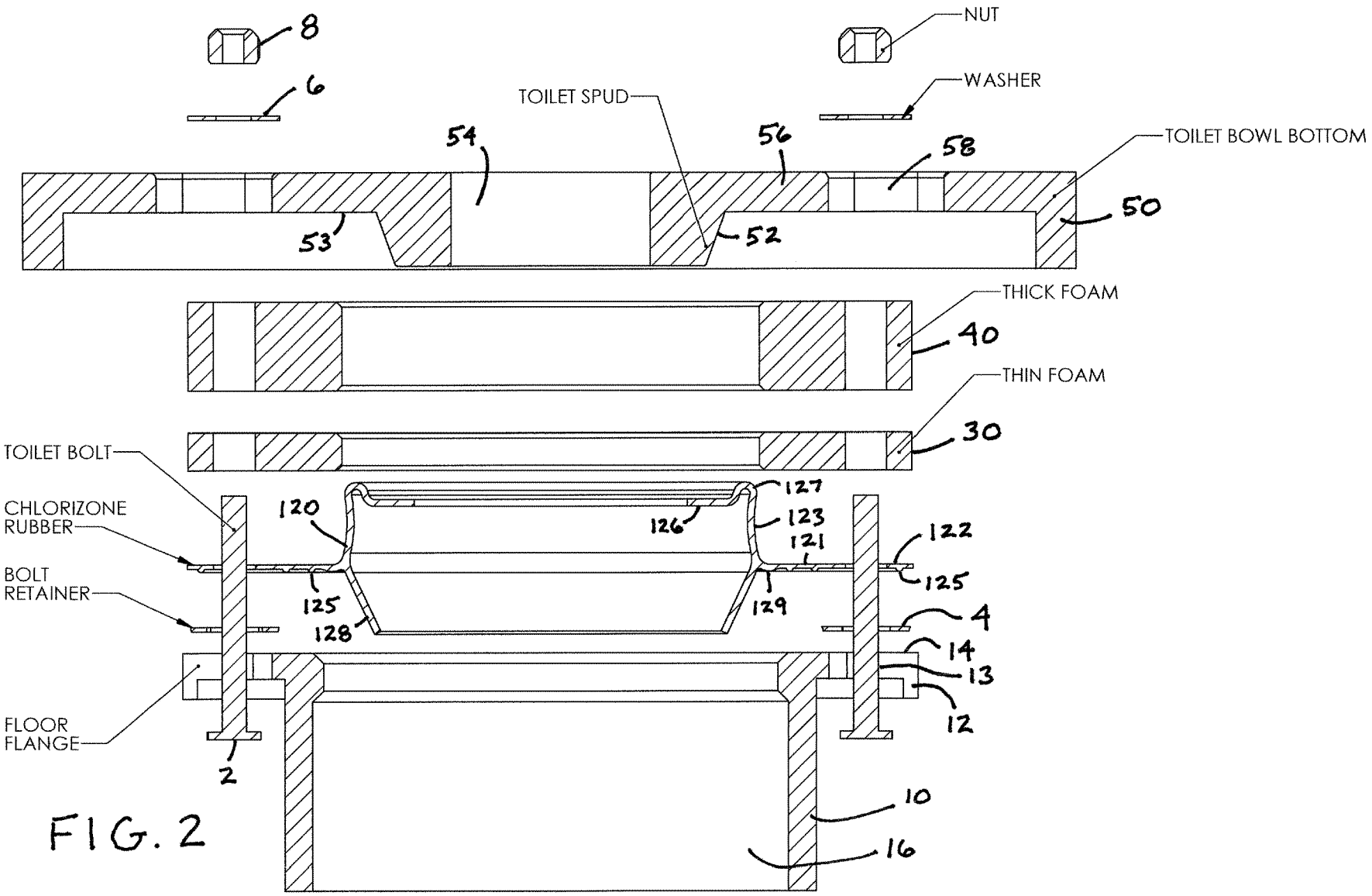
FIG. 2 is a side cross-sectional and exploded pre-installation view of a second preferred embodiment of the modular waxless seal described herein.
Figure 3:
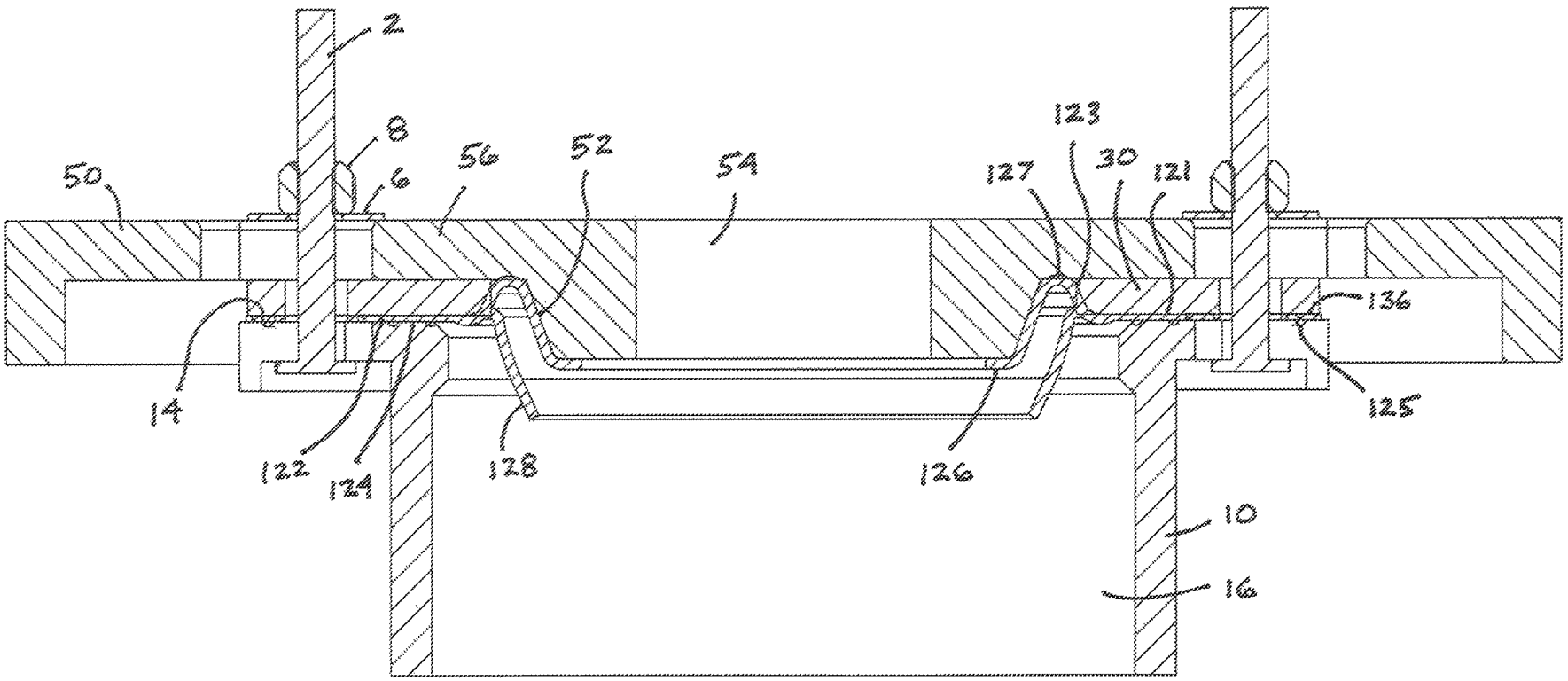
FIG. 3 is a view similar to FIG. 2 but showing the second preferred embodiment in a post-installation position.

Reference is now made to FIGS. 2 and 3 which illustrate a second preferred embodiment of the modular waxless seal of the present invention. The views are in cross-section and it is to be understood that the primary elements presented in this description are circular in shape.

As shown, a toilet bowl bottom 50 is configured and presented here as described above. As with the first embodiment, and to prevent leaks between the toilet spud 52 and the waste hole 16, the second embodiment of the invention herein provides a modular waxless seal 120 that includes at least one foam ring 30, 40 interposed therebetween. The seal 120 likewise comprises a chemical resistant Chlorazone® rubber and several essential elements that are integrally formed as a single structure. Those elements are a flat and horizontally disposed sealing ring 122 and a sealing wall 123 that comprises an inner radial structure that only allows the sealing wall 123 to roll inwardly, as shown in FIG. 3. Further, the sealing wall 123 extends upwardly from the innermost portion of the sealing ring 122 and a ring cone 128 that extends downwardly from the innermost portion of the sealing ring 122 is also provided.

More specifically, the modular waxless seal 120 comprises a planar and outwardly extending sealing ring 122 that has a top surface 121. Inwardly of the sealing ring 122, the rubber seal 120 further comprises an integrally formed ring cone 128 that is tapered inwardly and downwardly from the sealing ring 122. An integrally formed wall 123 extends upwardly from the upper perimeter of the ring cone 128. An inwardly formed and inverted U-shaped curve 127 and lip 126 are disposed at the top of the wall 123. This construction allows the wall 123, curve 127 and lip 123 to roll vertically downward when the spud 52 of the toilet bowl bottom 50 pushes down on them. See FIG. 3 wherein only the "thin" foam ring 30 is used in the embodiment that is shown to be compressed. The seal ring top surface 121 is substantially flat so as to provide a support surface for one or the other of the foam rings 30, 40. The sealing ring 122 further comprises a bottom surface 124 having a plurality of annular flange beads 125. The annular flange beads 125 are designed to provide a sealing interface with the top surface 14 of the floor flange 10 and to absorb any imperfections in that top surface 14 of the floor flange 10. A larger bead 129 is disposed at the top of the ring cone 128. As mentioned earlier, the rubber seal 120 and its sealing ring 122 in particular "bridges" and seals all openings on the floor flange 10.

As with the first preferred embodiment, the rubber seal 120 likewise comprises opposing protrusions or "ears" that extend outwardly from the main body of those elements, the ears having apertures aligning with the fasteners 2.

In view of the foregoing, it will be apparent that the present invention provides an improved modular waxless seal that allows for easy installation. It also provides an improved seal between the toilet and the floor flange. It will be further apparent that this inventive configuration effectively eliminates the mess created when installing and removing the wax seals of the prior art and greatly improves the ease of installation and removal for the installer.

The invention claimed is:

1. A modular waxless seal for sealing a connection between a bottom of a toilet, the toilet bottom comprising a toilet spud, and a floor flange, the floor flange comprising a central aperture and opposing fasteners that extend upwardly from the floor flange, the seal comprising:

a rubber seal portion comprising:

a substantially flat sealing ring configured for placement on top of the floor flange;

a sealing ring top surface;

a centrally disposed aperture defined within the flat sealing ring;

a sealing wall extending upwardly from the aperture of the flat sealing wall, the sealing wall having an upper edge;

the upper edge of the sealing wall forming an inwardly extending curved U-shaped portion; and an inwardly extending lip forming an aperture for receiving a portion of the toilet spud therethrough;

wherein the sealing wall, the upper edge of the sealing wall and the inwardly extending lip are configured to have an uncompressed state when the toilet bowl bottom and the toilet spud are not in contact with the seal portion and are further configured to have a compressed state when the toilet bowl bottom and the toilet spud are in contact with and seated on top of the seal portion;

a ring cone that extends downwardly from the centrally disposed aperture of the sealing ring; and at least one foam ring disposed above the top surface of the sealing ring of the rubber seal portion;

wherein the rubber seal portion and the at least one foam ring each further comprise opposing ears that extend outwardly; and wherein each opposing ear comprises an aperture that aligns with one of the opposing fasteners of the floor flange such that a portion of a fastener can pass through the ear apertures of the rubber seal portion and the at least one foam ring.

2. The modular waxless seal of claim 1 wherein each ear of the rubber seal portion comprises a sealing ring sleeve that extends upwardly from the ear such that a portion of a flange fastener can pass through the sleeve and the sleeve extends upwardly into an ear aperture of the foam ring.

3. The modular waxless seal of claim 1 wherein the rubber seal portion is chemical resistant and contains a germicide to prevent the rubber seal portion from supporting bacterial life.

4. The modular waxless seal of claim 1 wherein the at least one foam ring is an open cell foam having a sealing skin on all outer surfaces of the foam ring.

5. The modular waxless seal of claim 1 wherein the sealing ring further comprises a bottom surface and a plurality of annular flange beads that extend downwardly from the bottom surface.

6. The modular waxless seal of claim 5 wherein at least one of the plurality of annular flange beads extends further downwardly than the other beads.

7. The modular waxless seal of claim 1 wherein the at least one foam ring comprises a substantially rectangular toroid-shaped foam ring having a flat top and a flat bottom.

8. The modular waxless seal of claim 7 wherein:

the at least one foam ring comprises a pair of rectangular toroid-shaped foam rings;

a first rectangular toroid-shaped foam ring has a first thickness; and a second rectangular toroid-shaped foam ring has a second thickness that is less than the first thickness.

* * * * *